US008915791B2

(12) United States Patent
Gibson et al.

(10) Patent No.: US 8,915,791 B2
(45) Date of Patent: Dec. 23, 2014

(54) CONVERTIBLE ROCKING TOYS

(71) Applicant: Tek Nek Toys International, Inc., Colleyville, TX (US)

(72) Inventors: Jerry Gibson, Colleyville, TX (US); Nick Tung, Hong Kong (HK)

(73) Assignee: Tek Nek Toys International, Inc., Colleyville, TX (US)

( * ) Notice: Subject to any disclaimer, the term of this patent is extended or adjusted under 35 U.S.C. 154(b) by 71 days.

(21) Appl. No.: 13/747,781

(22) Filed: Jan. 23, 2013

(65) Prior Publication Data

US 2014/0206465 A1 Jul. 24, 2014

(51) Int. Cl.
*A63G 13/06* (2006.01)
*A63G 13/10* (2006.01)

(52) U.S. Cl.
CPC ..... *A63G 13/06* (2013.01)
USPC ..... 472/95; 472/101; 280/1.23

(58) Field of Classification Search
USPC ..... 472/95, 101, 102; 280/1.22, 1.23, 7.1, 280/7.15; 446/29
See application file for complete search history.

(56) References Cited

U.S. PATENT DOCUMENTS

| | | | | | |
|---|---|---|---|---|---|
| 256,390 | A | * | 4/1882 | Shepardson | 280/1.23 |
| 1,478,449 | A | | 12/1923 | Meister | |
| 2,497,265 | A | | 2/1950 | Leit | |
| 3,075,763 | A | * | 1/1963 | May | 280/1.22 |
| 3,100,364 | A | | 8/1963 | May | |
| 3,161,417 | A | * | 12/1964 | Goldfarb | 280/7.1 |
| 3,848,869 | A | | 11/1974 | Morrison | |
| 4,494,763 | A | * | 1/1985 | Whitehead | 280/1.175 |
| 5,022,667 | A | * | 6/1991 | Gillson | 280/1.188 |
| 6,161,847 | A | | 12/2000 | Howell | |

* cited by examiner

*Primary Examiner* — Kien Nguyen
(74) *Attorney, Agent, or Firm* — Dinsmore & Shohl LLP

(57) ABSTRACT

A convertible toy includes a body portion and a base selectively coupled to the body portion. The body portion includes a seat portion, a first pair of leg portions extending from the seat portion, and a first axle extending between the first pair of leg portions. The body portion also includes a second pair of leg portions extending from the seat portion and a second axle extending between the second pair of leg portions. The base includes a curved support portion, a first coupling member coupled to the curved support portion, and a second coupling member coupled to the curved support portion. The first axle of the body portion is selectively coupled to the first coupling member in at least one degree of freedom and the second axle of the body portion is selectively coupled to the second coupling member in at least two degrees of freedom.

20 Claims, 5 Drawing Sheets

CONVERTIBLE ROCKING TOYS

TECHNICAL FIELD

The present specification generally relates to convertible rocking toys and, in particular, to convertible toys that have both rocking and rolling movements.

BACKGROUND

The present disclosure is related to convertible toys, and in particular to rocking animal in which the toy resembles an animal, for example, a horse, a dog, or the like. Conventionally known rocking animals include representation of the features of the animal, and allow a child to sit astride the rocking animal to simulate riding. Such rocking horse toys provide amusement to the child users.

Children playing with rocking animals may wish to play with the rocking animal in alternative methods rather than solely rocking the rocking animal. Accordingly, convertible rocking toys that provide alternative movements to rocking alone may be desired.

SUMMARY

In one embodiment, a convertible toy includes a body portion and a base selectively coupled to the body portion. The body portion includes a seat portion, a first pair of leg portions extending from the seat portion, and a first axle extending between the first pair of leg portions. The body portion also includes a second pair of leg portions extending from the seat portion and a second axle extending between the second pair of leg portions. The base includes a curved support portion, a first coupling member coupled to the curved support portion, and a second coupling member coupled to the curved support portion. The first axle of the body portion is selectively coupled to the first coupling member in at least one degree of freedom and the second axle of the body portion is selectively coupled to the second coupling member in at least two degrees of freedom.

In another embodiment, a convertible toy includes a body portion and a base selectively coupled to the body portion. The body portion includes a seat portion, a first pair of leg portions extending from the seat portion, and a first axle extending between the first pair of leg portions. The body portion also includes a second pair of leg portions extending from the seat portion and a second axle extending between the second pair of leg portions. The base includes a curved support portion, a first coupling member coupled to the curved support portion, and a second coupling member coupled to the curved support portion. The first axle of the body portion is selectively coupled to the first coupling member in at least a longitudinal direction and the second axle of the body portion is selectively coupled to the second coupling member in at least the longitudinal direction and a vertical direction.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Convertible toys according to the present disclosure generally include a body portion and a base that is selectively coupled to the body portion. The body portion includes a seat portion upon which a user may sit astride. The body portion also includes a first pair of legs extending from the seat portion, a first axle extending between the first pair of legs, a second pair of legs extending from the seat portion, and a second axle extending between the second pair of legs. The first and second axles of the body portion are selectively coupled to first and second coupling members of the base. When engaged with the first and second axles, the first and second coupling members secure the body portion to the base such that the convertible toy can be rocked about a curved support portion of the base. At least one of the first or second coupling members may be selected to decouple the first or second axle, such that the body portion is easily removable from the base. As such, a child playing with the convertible toy may easily select between using the convertible toy in a rocking motion or in an alternative mode, including rolling.

Figure 1:
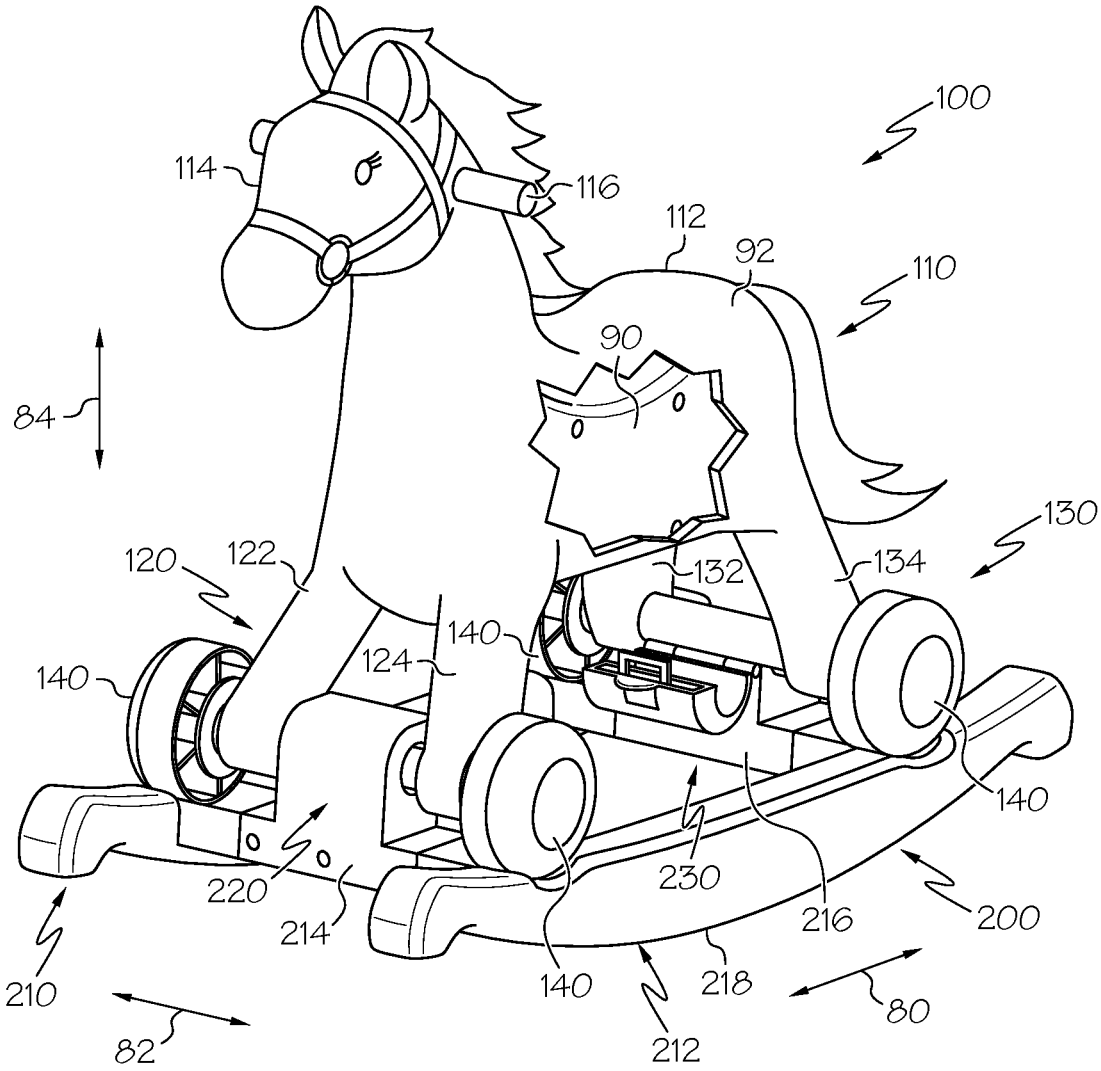
FIG. 1 schematically depicts a side perspective view of an assembled convertible toy according to one or more embodiments shown or described herein.

Referring now to FIG. 1, one embodiment of the convertible toy 100 is depicted. In the depicted embodiment, the convertible toy 100 is manufactured to generally resemble a horse. Other embodiments of the convertible toy may be manufactured to resemble a variety of animals including, for example and without limitation, dogs, cats, cows, donkeys, goats, and the like. The convertible toy 100 includes a body portion 110 and a base 200. The body portion 110 includes a seat portion 112 (here, corresponding to the thorax of the representative animal), a head portion 114 extending from the seat portion 112, and at least one grip handle 116 extending from the head portion 114. Embodiments of the body portion may be manufactured from a polymer frame 90 that is covered with a textile 92. The body portion 110 also includes a first front leg portion 122 and a second front leg portion 124 defining a first pair of leg portions 120, and a first rear leg portion 132 and a second rear leg portion 134 defining a second pair of leg portions 130.

Figure 2:
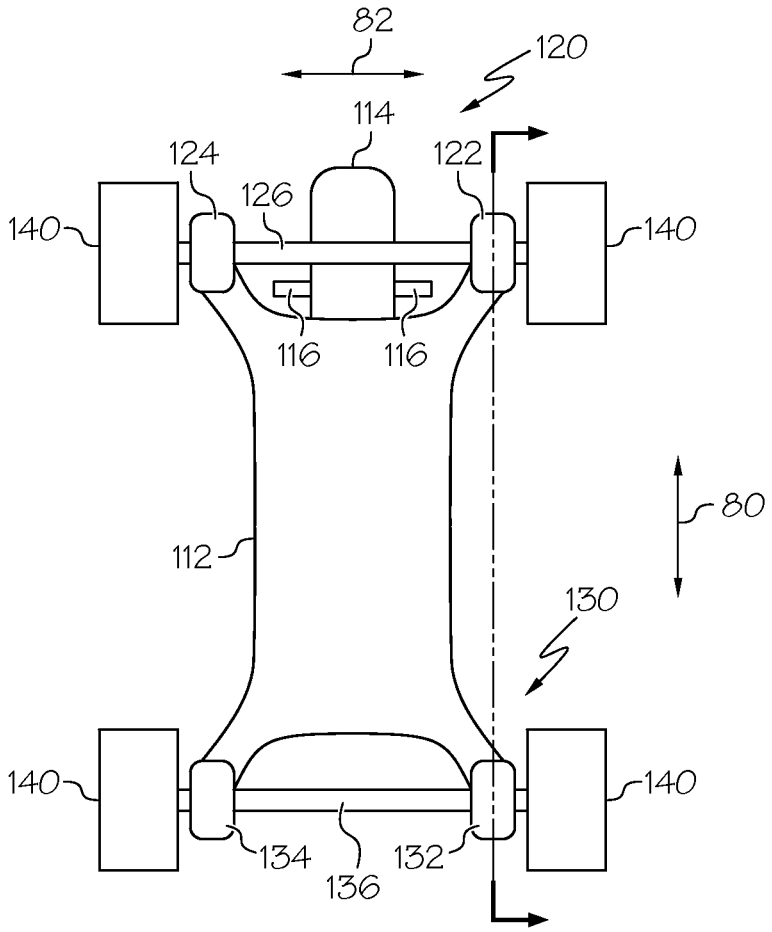
FIG. 2 schematically depicts a bottom view of a body portion of a convertible toy according to one or more embodiments shown or described herein.

Referring to FIG. 2, the body portion 110 also includes a first axle 126 that extends between the first pair of leg portions 120 and a second axle 136 that extends between the second pair of leg portions 130. In the depicted embodiment, the body portion 110 includes a plurality of wheels 140 aligned with the first axle 126 and the second axle 136 and free to rotate. In the depicted embodiment, the first axle 126 and the second axle 136 are fixed to the first pair of leg portions 120 and the second pair of leg portions 130, respectively, and the wheels 140 rotate relative to the first and second axles 126, 136. In other embodiments, the first and second axles 126, 136 may rotate relative to the first and second pair of leg portions 120, 130, respectively.

Figure 3:
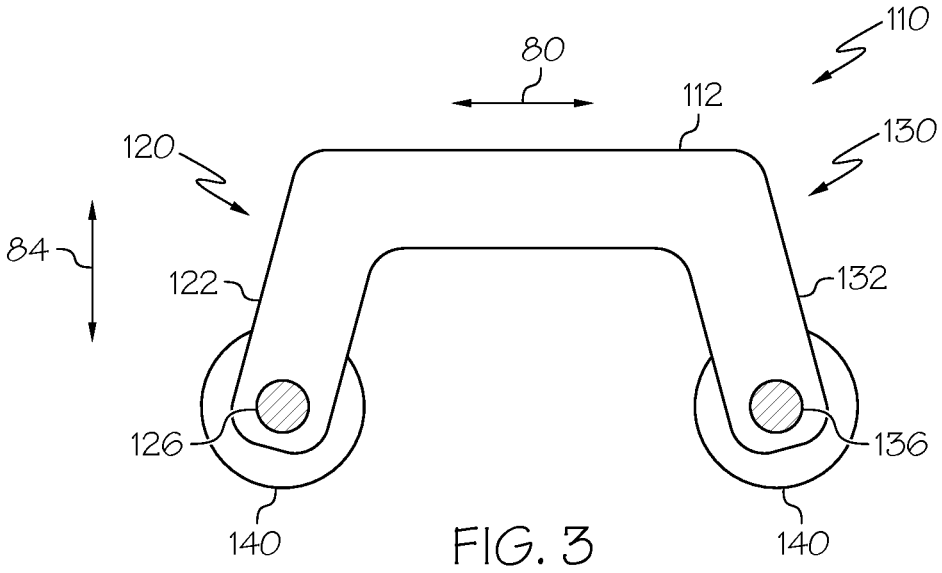
FIG. 3 schematically depicts a cross-sectional side view of the body portion of the convertible toy shown along line A-A of FIG. 2.

Referring to FIG. 3, the wheels 140 may have a diameter and be positioned relative to the first front leg portion 122, the second front leg portion, the first rear leg portion 132, the second rear leg portion such that at least a portion of the wheels 140 extend to a position in a vertical direction 84 below the first and second pair of leg portions 120, 130. When the body portion 110 of the convertible toy 100 is detached from the base and the body portion 110 is positioned on a ground surface, the wheels 140 contact the ground surface. As such, the body portion 110 of the convertible toy 100 is free to roll along the ground surface when the body portion 110 is detached from the base.

Referring again to FIG. 1, in the depicted embodiment, the base 200 includes a first rail 210 and a second rail 212 that extend in a generally longitudinal direction 80 corresponding to the body portion 110. The rails 212 are spaced apart from one another in a lateral direction 82 and are coupled to one another by a first support member 214 and a second support member 216, each of which extend in the generally lateral direction 82 transverse to the longitudinal direction 80. The rails 212 include a curved support portion 218 that is positioned generally positioned to contact a ground surface. The base 200 also includes a first coupling member 220 coupled to the first support member 214 and a second coupling member 230 coupled to the second support member 216. As will be described in greater detail below, the first coupling member 220 and the second coupling member 230 selectively couple the first and second axles 126, 136 of the body portion 110 to the base 200. When the body portion 110 is selectively coupled to the base 200, a user may sit astride the seat portion 112 of the convertible toy 100 and rock the convertible toy 100 along the curved support portion 218 of the base 200.

As depicted in FIG. 1, the positioning of the first pair of leg portions 120 such that the first pair of leg portions 120 contact the first coupling member 220 on opposite sides may limit translation of the body portion 110 relative to the base 200 in the lateral direction 82 when the body portion 110 is coupled to the base 200. Similarly, the positioning of the second pair of leg portions 130 such that second pair of leg portions 130 contact the second coupling member 220 on opposite sides may further limit translation of the body portion 110 relative to the base 200 in the lateral direction 82 when the body portion 110 is coupled to the base 200.

Figure 4:
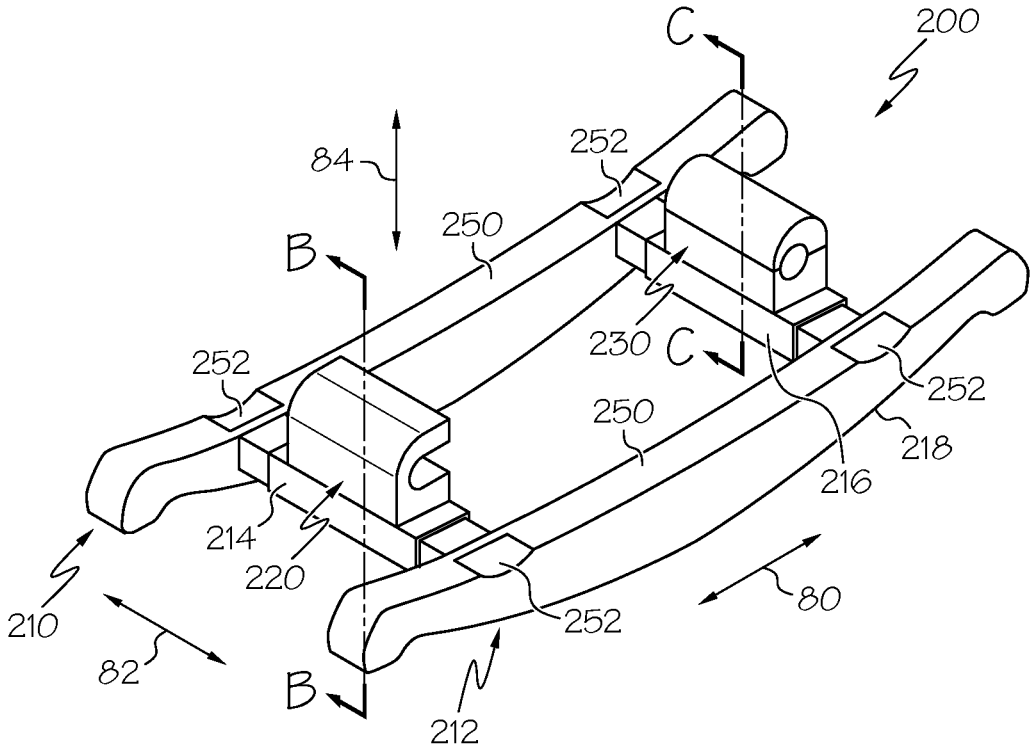
FIG. 4 schematically depicts a side perspective view of a base of a convertible toy according to one or more embodiments shown or described herein.
Figure 5:
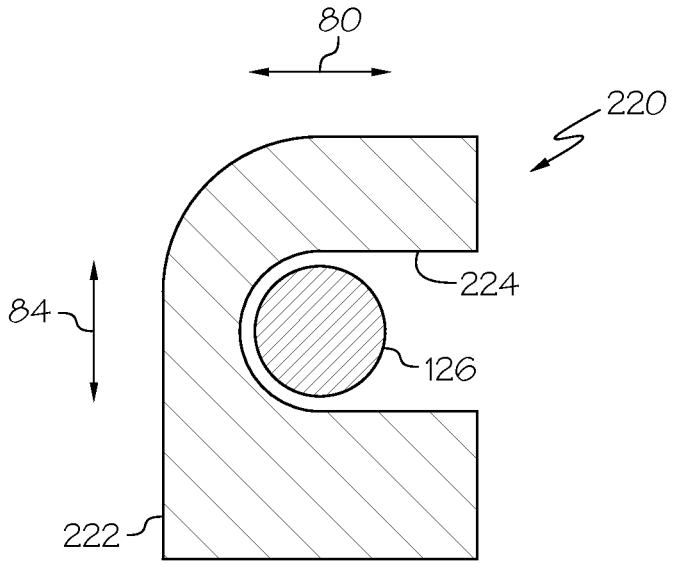
FIG. 5 schematically depicts a cross-sectional side view of the convertible toy shown along line B-B of FIG. 4.

Referring to FIG. 4, the base 200 is depicted independently of the body portion. The base 200 includes the first coupling member 220 positioned on the first support member 214, and positioned between the rails 212. The first coupling member 220 is also reproduced in FIG. 5. In the depicted embodiment, the first coupling member 220 includes a bracket 222 having an opening 224 that extends in the longitudinal direction 80. When the body portion is assembled with the base 200, the first axle 126 of the body portion is positioned within the opening 224 of the bracket 222. When positioned within the opening 224, the first axle 126 is constrained from translating in at least one degree of freedom. As depicted, the first axle 126 is constrained from translating in the vertical direction 84 by the bracket 222.

The base 200 may include a plurality of depressions 252 that are positioned in an upper surface 250 of the first and second rails 210, 212 opposite the curved support portion 218. The depressions 252 are inset downwards in the vertical direction 84 from the upper surface 250 of the first and second rails 210, 210, and provide clearance for the wheels 140 of the body portion 110 (as depicted in FIG. 1). The depressions 252 may allow for lower positioning of the height of the seat portion 112 of the body portion 110 in the vertical direction 84 relative to the ground surface.

Figure 6:
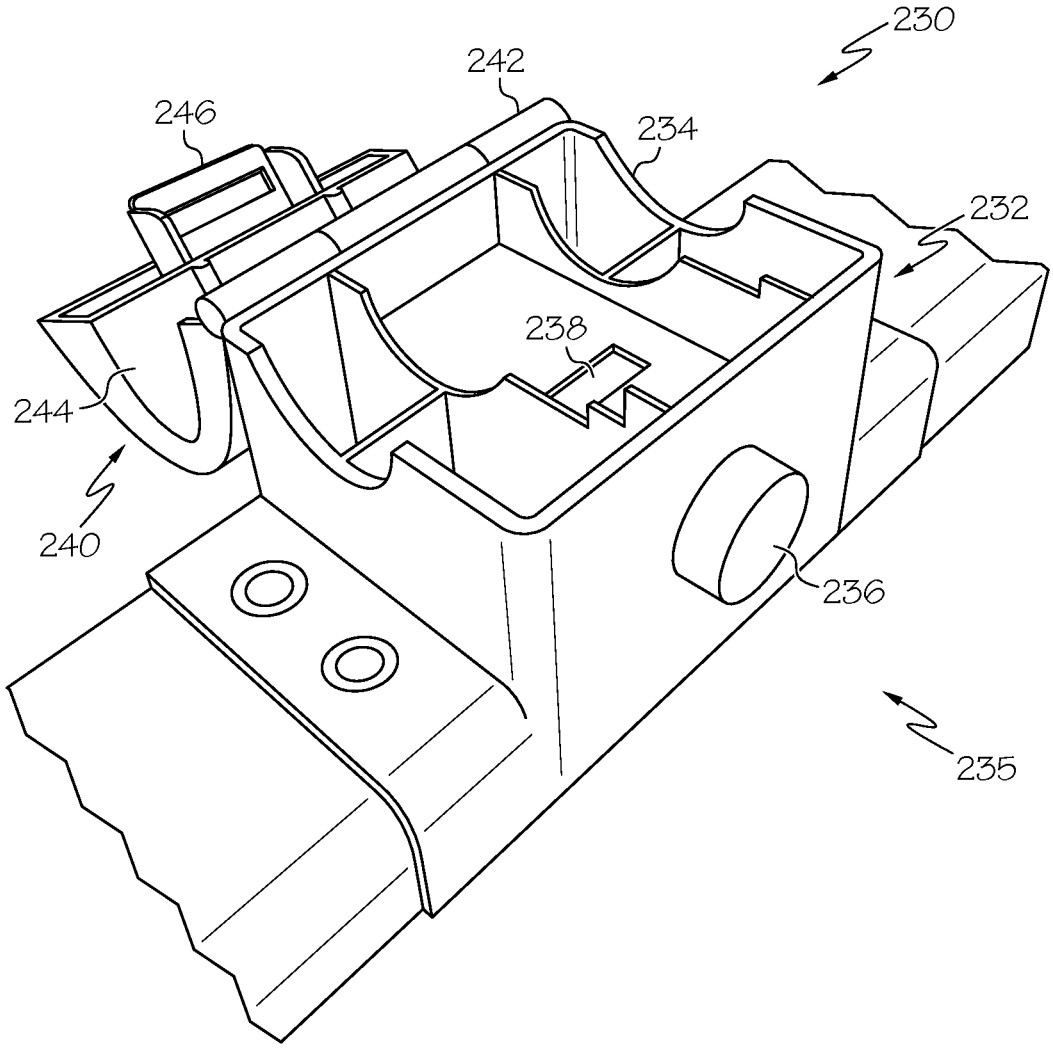
FIG. 6 schematically depicts a side perspective view of a coupling member of a convertible toy according to one or more embodiments shown or described herein.

Referring again to FIG. 4, the base 200 includes the second coupling member 230 that is positioned on the second support member 216 and is positioned between the rails 212. The second coupling member 230 is reproduced in FIGS. 6-8. Referring to FIG. 6, the second coupling member 230 is depicted independently from other components of the base. The coupling member 230 includes a base portion 232, a cover portion 240, and a latch 235 that selectively couples the cover portion 240 to the base portion 232. The base portion 232 and the cover portion 240 incorporate a hinge 242 that allows the cover portion 240 to rotate between a locked position and an unlocked position, while maintaining attachment of the cover portion 240 to the base portion 232. The cover portion 240 may include a latch strike 246. When the cover portion 240 is maintained in the locked position by the latch 235, the latch strike 246 extends through an aperture 238 in the base portion, and the latch strike 246 is coupled by the latch 235. The latch 235 may include a spring-loaded latch release 236 that is biased to maintain the latch strike 246 in the aperture 238 and maintain the cover portion 240 in the locked position.

The base portion 232 includes a base relief region 234 and the cover portion 240 includes a cover relief region 244. When the cover portion 240 is maintained in the locked position relative to the base portion 232, the base relief region 234 and the cover relief region 244 provide clearance to accept the second axle 136 of the body portion, as depicted in FIGS. 7 and 8.

Figure 7:
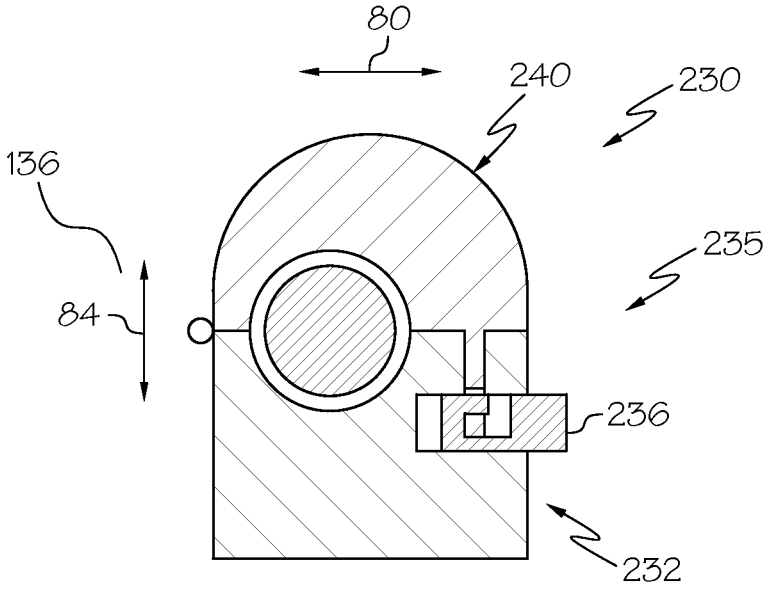
FIG. 7 schematically depicts a cross-sectional side view of the convertible toy shown along line C-C of FIG. 4.

Referring to FIG. 7, when the cover portion 240 is maintained in the locked position relative to the base portion 232 by the latch 235, the second axle 136 is secured in at least two degrees of freedom. As depicted in FIG. 7, the second axle 136 is constrained from moving in the longitudinal direction 80 and the vertical direction 84. When used in combination with the first coupling member 220 (depicted in FIGS. 4 and 5), the first coupling member 220 and the second coupling member 230 secure the first axle 126 and the second axle 136 of the body portion in the longitudinal direction 80 and the vertical direction 84.

Figure 8:
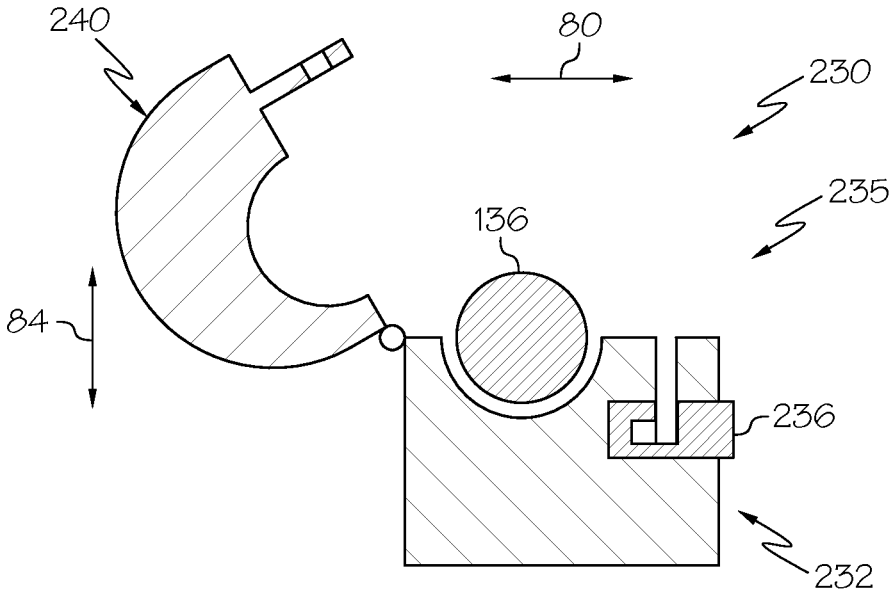
FIG. 8 schematically depicts a cross-sectional side view of the convertible toy shown along line C-C of FIG. 4.

Referring now to FIG. 8, the latch 235 may be actuated to selectively release the cover portion 240 from the base portion 232, and rotate the cover portion 240 to an unlocked position. With the cover portion 240 positioned in the unlocked position, the second axle 136 of the body portion is no longer coupled to the second coupling member 230. As such, the second axle 136 of the body portion is free to move in at least one degree of freedom. As depicted in FIG. 8, the second axle 136 is free to move in at least the vertical direction 84.

With the second axle 136 free to move in the vertical direction 84, the body portion of the convertible toy may be repositioned such that the second axle 136 is removed from the second coupling member 230. With the second axle 136 removed from the second coupling member 230, the body portion may be translated in the longitudinal direction 80 corresponding to the direction of the opening 224 of the first coupling member 220 (depicted in FIG. 5), such that the first axle 126 of the body portion is removed from the first coupling member 220. With the first axle 126 being removed from the first coupling member 220 and the second axle 136 being removed from the second coupling member 230, the body portion 110 of the convertible toy 100 is selectively removable from the base 200. The base 200 may be set aside so that a user can play with the body portion 110 of the convertible toy 100. In the embodiments depicted herein, the wheels 140 of the body portion 110 may allow the body portion 110 of the convertible toy 100 to translate in the generally longitudinal direction 80. The user may sit astride the body portion 110 of the convertible toy 100 and roll the body portion 110 in the generally longitudinal direction 80.

While discussion hereinabove has been directed to the embodiments depicted in FIGS. 1-8, it should be understood that variations to the device may be incorporated without departing from the scope of the present disclosure. For example, while discussion herein has described the first and second coupling members and their relative positioning, it should be understood that the positioning of the first and second coupling members relative to the body portion and the base may be modified. Further, the degrees of freedom that the first and second coupling members couple the first and second axles of the body portion may differ from those depicted in FIGS. 1-8, for example, by rotating the relative position of the first and second coupling members to the base. In addition, some embodiments of the convertible toy may include duplication of the components of the second coupling member.

Embodiments of the convertible toy may also include an electronics system having a memory, a processor, an actuation sensor, and an output device. When the actuation sensor is actuated, the processor executes a computer readable instruction set stored in the memory and commands the output device to perform an operation. In one embodiment, the convertible toy may include musical information stored in the memory that is played through a speaker incorporated into the convertible toy.

It should now be understood that convertible toys according to the present disclosure include first and second coupling members that selectively couple the body portion of the convertible toy to the base. When the body portion is coupled to the base, the convertible toy may be used by a user in a first mode, here a rocking mode. When the body portion is selectively decoupled from the base, the convertible toy may be used by a user in a second mode, here a rolling mode. The first and second coupling members provide easy and reliable coupling and decoupling of the body portion to the base portion.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A convertible toy comprising:

a body portion comprising:

a seat portion;

a first pair of leg portions extending from the seat portion;

a first axle extending between the first pair of leg portions;

a second pair of leg portions extending from the seat portion; and a second axle extending between the second pair of leg portions, and a base selectively coupled to the body portion, the base comprising a curved support portion, a first coupling member coupled to the curved support portion, and a second coupling member coupled to the curved support portion, the second coupling member comprising a base portion, a cover portion, and a latch that selectively couples the cover portion to the base portion, wherein the first axle of the body portion is selectively coupled to the first coupling member in at least one degree of freedom and the second axle of the body portion is selectively coupled to the second coupling member in at least two degrees of freedom.

2. The convertible toy of claim 1, wherein the second coupling member further comprises a hinge coupled to the base portion and the cover portion.

3. The convertible toy of claim 1, wherein the latch comprises a spring-loaded latch release.

4. The convertible toy of claim 1, wherein the second coupling member selectively opens, thereby decoupling the second axle from the base portion in at least one degree of freedom.

5. The convertible toy of claim 1, wherein the first coupling member comprises a bracket having an opening that extends in a longitudinal direction.

6. The convertible toy of claim 1, wherein the first coupling member at least partially constrains the first axle in a second degree of freedom.

7. The convertible toy of claim 1, wherein the first pair of leg portions selectively contact the first coupling member and the second pair of leg portions selectively contact the second coupling member to limit translation of the body portion relative to the base in a lateral direction.

8. The convertible toy of claim 1, wherein the base further comprises a plurality of rails that extend in a longitudinal direction and are coupled to one another by support members that extend in a lateral direction.

9. The convertible toy of claim 1, wherein the body portion further comprises a plurality of wheels coupled to the first axle and the second axle, and at least a portion of the wheels extend to a position below the first pair of leg portions and the second pair of leg portions.

10. The convertible toy of claim 9, wherein the base further comprises a plurality of depressions inset downwards from an upper surface of the base opposite the curved support portion.

11. The convertible toy of claim 1, wherein the first coupling member selectively couples the first axle to the curved support portion in a vertical direction and the second coupling member selectively couples the second axle to the curved support portion in the vertical direction and a longitudinal direction.

12. The convertible toy of claim 1, wherein the body portion comprises a polymeric frame and a textile covering.

13. A convertible toy comprising:

a body portion comprising:

a seat portion;

a first pair of leg portions extending from the seat portion;

a first axle extending between the first pair of leg portions;

a second pair of leg portions extending from the seat portion; and a second axle extending between the second pair of leg portions, and a base selectively coupled to the body portion, the base comprising a curved support portion, a first coupling member coupled to the curved support portion, and a second coupling member coupled to the curved support portion, wherein:

the first axle of the body portion is selectively coupled to the first coupling member in at least a longitudinal direction and the second axle of the body portion is selectively coupled to the second coupling member in at least the longitudinal direction and a vertical direction; and the first pair of leg portions selectively contact the first coupling member and the second pair of leg portions selectively contact the second coupling member to limit translation of the body portion relative to the base in a lateral direction.

14. The convertible toy of claim 13, wherein the body portion further comprises a plurality of wheels coupled to the first axle and the second axle, and at least a portion of the wheels extend to a position below the first pair of leg portions and the second pair of leg portions.

15. The convertible toy of claim 13, wherein the second coupling member comprises a base portion, a cover portion, and a latch that selectively couples the cover portion to the base portion.

16. The convertible toy of claim 15, wherein the latch comprises a spring-loaded latch release.

17. The convertible toy of claim 15, wherein the second coupling member selectively opens, thereby decoupling the second axle from the base portion in at least one degree of freedom.

18. The convertible toy of claim 13, wherein the base further comprises a plurality of rails that extend in a longitudinal direction and are coupled to one another by support members that extend in a lateral direction.

19. A convertible toy comprising:

a body portion comprising:

a seat portion;

a first pair of leg portions extending from the seat portion;

a first axle extending between the first pair of leg portions;

a second pair of leg portions extending from the seat portion; and a second axle extending between the second pair of leg portions, and a base selectively and removably coupled to the body portion, the base comprising a curved support portion, a first coupling member coupled to the curved support portion, and a second coupling member coupled to the curved support portion, wherein the first axle of the body portion is selectively and removably coupled to the first coupling member of the base and the second axle of the body portion is selectively and removably coupled to the second coupling member of the base.

20. The convertible toy of claim 19, wherein the second coupling member comprises a base portion, a cover portion, and a latch that selectively couples the cover portion to the base portion.

* * * * *